US008162771B2

(12) United States Patent
Bergstrom

(10) Patent No.: US 8,162,771 B2
(45) Date of Patent: Apr. 24, 2012

(54) METHOD FOR PRACTICING A BILLIARD SHOT

(75) Inventor: Richard Bergstrom, Glen Carbon, IL (US)

(73) Assignee: Brandee Bergstrom, Pasadena, CA (US)

( * ) Notice: Subject to any disclaimer, the term of this patent is extended or adjusted under 35 U.S.C. 154(b) by 229 days.

(21) Appl. No.: 12/113,683

(22) Filed: May 1, 2008

(65) Prior Publication Data

US 2009/0275417 A1 Nov. 5, 2009

(51) Int. Cl.
*A63D 15/00* (2006.01)

(52) U.S. Cl. ..... 473/2; 473/4

(58) Field of Classification Search ..... 473/2, 4, 473/10, 6, 14, 28, 158, 387, 388
See application file for complete search history.

(56) References Cited

U.S. PATENT DOCUMENTS

| | | | | | |
|---|---|---|---|---|---|
| 736,938 | A | * | 8/1903 | Clark | 473/14 |
| 1,143,222 | A | | 6/1915 | Nathan | |
| 1,349,099 | A | * | 8/1920 | Redpath | 215/394 |
| 1,611,332 | A | * | 12/1926 | Bunnell | 473/389 |
| 1,783,211 | A | * | 12/1930 | Baldwin | 473/257 |
| 1,813,116 | A | * | 7/1931 | Clausen | 473/20 |
| 1,930,415 | A | * | 10/1933 | Cantine | 215/394 |
| 2,072,688 | A | * | 3/1937 | Rose | 473/388 |
| 3,463,489 | A | * | 8/1969 | Tretow | 473/18 |
| 3,466,038 | A | | 9/1969 | Hill | |
| 3,509,003 | A | * | 4/1970 | Engle | 428/78 |
| 3,704,887 | A | * | 12/1972 | Thorton | 473/2 |
| 3,899,179 | A | * | 8/1975 | Vlach | 473/218 |
| 4,004,804 | A | | 1/1977 | Gholson | |
| 4,063,728 | A | * | 12/1977 | Zemanek | 473/13 |
| 4,120,494 | A | * | 10/1978 | Roe | 473/2 |
| 4,128,245 | A | * | 12/1978 | Vlach | 473/218 |
| 4,151,990 | A | | 5/1979 | Josenhans | |
| 4,183,523 | A | | 1/1980 | Hecht | |
| 4,251,072 | A | * | 2/1981 | Anthony | 473/18 |
| 4,688,796 | A | | 8/1987 | Wright | |
| 5,183,254 | A | * | 2/1993 | Jones | 473/4 |
| 6,038,702 | A | * | 3/2000 | Knerr | 2/244 |
| 6,045,450 | A | | 4/2000 | Cyr | |
| 6,074,720 | A | | 6/2000 | Van Stratum | |
| 6,513,807 | B1 | * | 2/2003 | Lynch | 273/119 R |
| 6,629,897 | B2 | | 10/2003 | Belknap | |
| 6,761,643 | B2 | * | 7/2004 | Boatwright | 473/2 |
| D495,388 | S | * | 8/2004 | Toms | D21/717 |
| 6,827,651 | B1 | | 12/2004 | Davis | |
| 6,875,120 | B1 | | 4/2005 | Ellis | |
| 6,986,714 | B2 | * | 1/2006 | Porper et al. | 473/1 |

(Continued)

FOREIGN PATENT DOCUMENTS

GB 2195902 A * 4/1988

*Primary Examiner* — Mitra Aryanpour
(74) *Attorney, Agent, or Firm* — Polster, Lieder, Woodruff & Lucchesi, L.C.

(57) ABSTRACT

A method for practicing a billiard shot includes defining a position for each particular one billiard ball within the plurality of billiard balls on the surface of the billiard table, using a defined device having a defined body, selectively securing each device to the surface of the billiard table with each ball within the cavity of the corresponding device in its first position, taking a first billiard shot, replacing each of the two or more billiard balls to their first position on the surface of the billiard table, and taking a second billiard shot including the replaced two or more billiard balls.

6 Claims, 3 Drawing Sheets

U.S. PATENT DOCUMENTS

| | | | | |
|---|---|---|---|---|
| 7,303,483 | B2 | 12/2007 | Black | |
| D576,694 | S * | 9/2008 | Hanes, III | D21/714 |
| 7,658,680 | B2 * | 2/2010 | Malak | 473/2 |
| 2004/0254024 | A1 | 12/2004 | Thomas | |
| 2005/0101395 | A1 | 5/2005 | Keating | |
| 2006/0128488 | A1 | 6/2006 | Pappas | |
| 2008/0132344 | A1 * | 6/2008 | Malak | 473/2 |
| 2009/0111594 | A1 * | 4/2009 | Spence | 473/2 |

* cited by examiner

METHOD FOR PRACTICING A BILLIARD SHOT

FIELD

The present disclosure relates to billiards and, more specifically, to devices and methods for repetitively practicing a billiard shot.

BACKGROUND

The statements in this section merely provide background information related to the present disclosure and may not constitute prior art.

Pocket billiards, which is commonly referred to as "pool," is a commonly played game of both amateurs and professionals. In order to be successful at playing billiards, one must have both the knowledge of where to strike a cue ball and the other balls to produce the desired ball movement, such as into one of the holes, and also the user must have the shot making skill to make the shot correctly. The knowledge of ball striking and movement is often obtained through personal instruction, literature, and/or experience. The typical occasional player can be somewhat successful by "eye-balling" both the desired point of impact between the cue stick and the cue ball, and between the cue ball and the object ball, and then attempting the shot. However, because of the variation in "eye-balling" between each shot, that method necessarily requires a great many shots before the player develops the skill to make it properly and consistently. However, to develop advanced skill in shot making, a player must practice shots during many hours of practice of repeating the same or similar ball placement and shots.

For example, to become proficient and a skilled player, the player must develop the skill to impart spin or "English" on the cue ball to affect its trajectory, as well as the trajectory of the object ball or balls. English is used by skilled players to control the cue ball after impact with an object ball for placement of the cue ball for the next shot. English is also used to provide for placement of the cue ball following a shot to make an opponents next shot more difficult, to prevent the cue ball from rolling into one of the pockets following a shot, commonly called a scratch, and/or imparting spin onto an object ball. As such, a player must develop the requisite skill to effectively impart English to a cue ball and understand how the cue ball will react in various situational shot types.

While there have been several training methods and systems for spotting balls on tables to enable a player to repeat shots, these are not easily used or readily available to many users or at various locations. As such, the inventor of the present invention has developed a device, system and method for aiding in the training and development of skill in billiard shot making.

SUMMARY

The inventor hereof has succeeded at designing improved devices, systems and methods for repetitively practicing a billiard shot by, among other features, enabling the player to repetitively place each of the balls into substantially the same position during a practice session.

According to still another aspect, a method of using a plurality of devices for repetitively practicing a billiard shot with a set of a plurality of billiard balls on a surface of a billiard table, the method including defining a position for each particular one billiard ball within the plurality of billiard balls on the surface of the billiard table, each of the billiard balls in the set of billiard balls having a predefined first position on the surface of the billiard table, the defining including positioning a plurality of devices about each billiard ball on the surface of the billiard table, each device having an upper planar surface, a lower planar surface for flat placement on the surface of the billiard table with the lower planar surface being substantially parallel to the upper surface, an outer edge defining an outer diameter and a cavity defining an inner edge having an inner diameter, wherein the inner diameter is slightly greater than an outer diameter of a standard billiard ball and wherein the lower and upper planar surfaces are defined between the inner and outer diameters and wherein positioning each device about each billiard ball on the surface of the billiard table includes positioning each ball within the cavity of a corresponding one of the devices, each device having a thickness between the upper planar surface and the lower planar surface that is substantially minute, wherein each device has a substantially planar profile defined between the upper planar surface and the lower planar surface and the thickness of the device provides no more than a minimal impact to a travel of the billiard ball over the upper planar surface of the device and across the surface of the billiard table after the device is positioned about the billiard ball and flat on the billiard table surface. The method also includes selectively securing each device to the surface of the billiard table with each ball within the cavity of the corresponding device in its first position by attaching an adhesive material from the entire lower planar surface of the device to the surface of the billiard table. The method further includes taking a first billiard shot including the two or more of the billiard balls while each billiard ball is within the cavity of each corresponding device in their first position, the taking including a first movement for each of two or more of the billiard balls about the surface of the billiard table from their first position and to a second position for each of the two or more billiard ball with the second position being outside of the cavity of the corresponding device. The method includes replacing each of the two or more billiard balls to their first position on the surface of the billiard table and within the cavity of each corresponding device. The method also includes taking a second billiard shot including the replaced two or more billiard balls, the taking of the second billiard shot including a second movement for each of the two or more billiard balls about the surface of the billiard table from their first position and to a third position outside of the device cavity, wherein the third position of each of the two or more billiard balls is different than the second position thereof.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

Figure 1A:
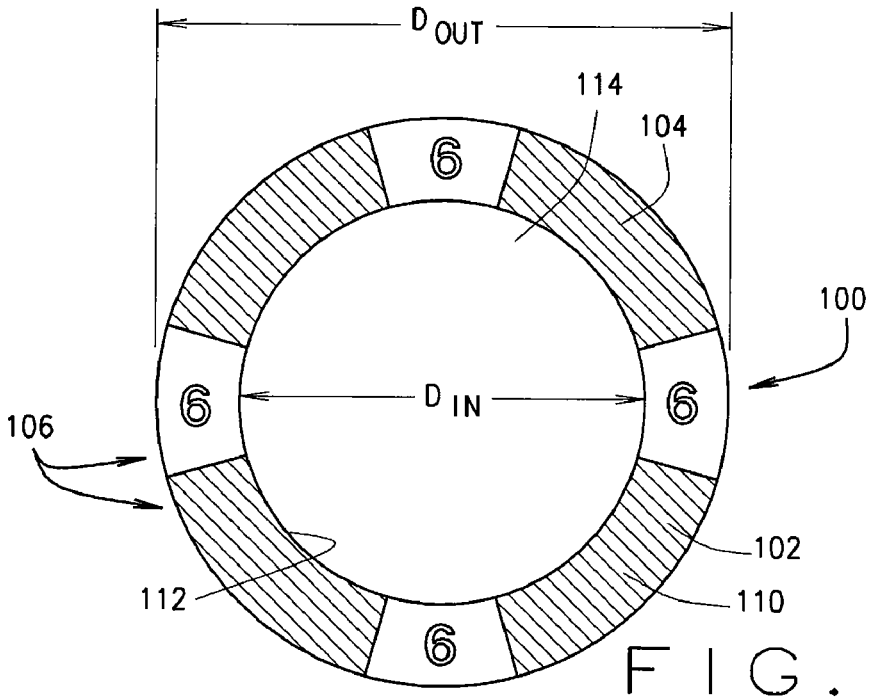
FIG. 1A is top planar view of a billiard shot practicing device having a full circular body and including unique ball indicia according to one exemplary embodiment.

The following description is merely exemplary in nature and is not intended to limit the present disclosure or the disclosure's applications or uses.

Before turning to the figures and the various exemplary embodiments illustrated therein, a detailed overview of various embodiments and aspects is provided for purposes of breadth of scope, context, clarity, and completeness.

In some embodiments, a device for repetitively practicing a billiard shot includes a body having an upper surface and a lower surface that is substantially parallel to the upper surface. In some embodiments, the body has a thickness between the upper and lower surfaces that is substantially minute or thin such that the cross sectional area is a substantially planar profile. A variety of materials can be used to form the body including paper, plastic, composite, and cloth, such as felt, by ways of example. In some embodiments, the material and thickness of the body is substantially negligible such that the body does not affect or impede the travel of any of the pool balls across the table surface, which is often composed of a cloth material such as felt.

An outer edge is defined by an outer diameter and a cavity is defined by an inner edge having an inner diameter. The inner diameter is slightly greater than an outer diameter of a billiard ball. While the dimensions can vary dependent on the application, in some embodiments, the inside diameter is about 2 and ⅜ inches and the outer diameter is about 2 and ⅝ inches. However, in some embodiments, inner diameter can be less than the outer diameter of the ball, but in such embodiments the body cannot be placed over a preplaced ball on the surface of the table, unless specifically configured with a gap, as described below. The lower and upper surfaces are defined between the inner and outer diameters. Such as body can be in the form of a circle surrounding defining a circular cavity similar to the shape of a billiard ball or can be another shape. For example, the body can be formed as a substantially circular C-shaped defining two free ends by the upper and lower surface wherein a gap is formed between the two free ends between the outer edge and the inner edge.

While the body can be plane and without marking, in some embodiments the upper surface includes indicia uniquely identifying a particular billiard ball from among a set of billiard balls. For example, this indicia can include a color, number or pattern (such as solid or stripe) of a billiard ball. In other embodiments, the upper surface can be adapted or suitable for a player to mark or write on to provide a player added indicia for identifying one or more balls for which the device is used to indicate a placement upon the billiard playing surface. One skilled in the art of billiards will also understand that a plurality of bodies will aid in the practicing of a billiard shot and in such embodiments, each body can include a different indicia on the upper surface identifying a different billiard ball from among a set of billiard balls.

The lower surface of the body can be a smooth material or surface or can be slightly rough for minimizing the movement of the body on the felt surface of the table. In other embodiments, an adhesive material can be applied to at least a portion of the lower surface of the body for aiding in the placement and temporary and selectively securing of the body to the surface of the table. In some embodiments, the adhesive material is such that there is a temporary bond to the felt surface that can be easily removed without causing harm to the felt surface or imparting an adhesive residue to the felt material of the surface.

In some embodiments, a plurality of bodies can be assembled together in a stack of bodies. Such a stack can be like a pad of paper wherein the user tears off or removes the top most one for first use. In some such cases, the adhesive material of one body can be selectively affixed to the upper surface of an adjacent body such that the bodies for a stack such as a stack of posting notes used in homes and offices and having a strip of adhesive material along one side of the back surface. There can be a different stack for each billiard ball or a single stack can include one or more sets of billiard balls, possibly in different sets for use with different practiced shots.

The pad or stack of bodies can be provided similar to the stack of common posting notes as are commonly known. Such a stack however will be formed as per the above design (such as a circle or a C-shape) that includes the inner diameter and the cavity and is different than the common square or rectangular posting note sheets of a posting note pad. Additionally, the adhesive can be across the entire bottom surface or can be only on portions of the bottom surface which can aid in the removal of the device from the stack and also from the felt surface of the table. Such a stack of bodies can also include each separately being of a different ball indicia or in other embodiments, each stack can include multiple copies of the same ball indicia wherein a separate stack will be provided for each ball within a set of billiard balls. In these arrangements, each body is removed from a stack of bodies for placement about each appropriate ball and onto the surface of the table. These can be designed for multiple uses or can be generally disposable after one or more uses.

In another embodiment, a system for repetitively practicing a billiard shot includes a plurality of bodies each having an upper surface and a lower surface that is substantially parallel to the upper surface. An outer edge is defined by an outer diameter and a cavity is defined by an inner diameter that is slightly greater than an outer diameter of a billiard ball. The lower and upper surfaces are defined between the inner and outer diameters. Each of the bodies includes different indicia on the upper surface identifying a different billiard ball from among a set of billiard balls.

Figure 1B:
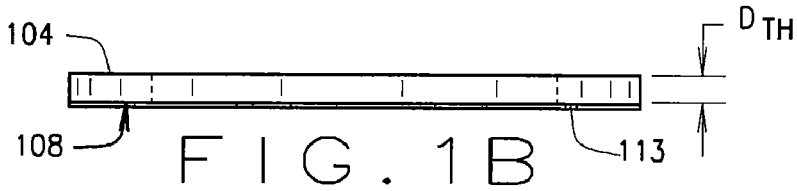
FIG. 1B is side view of a billiard shot practicing device of FIG. 1A.

Referring now to the figures, FIG. 1A illustrates one embodiment of a device 100 for repetitively practicing a billiard shot having a body 102 with an upper surface 104 with unique indicia 106 reflecting that this particular device 100 is associated with the number 6 ball. In this example, the indicia 106 includes the number 6, the solid color marking between the four sets of number 6 and the color green that is associated with the number 6 billiard ball. A lower surface 108 is shown in FIG. 1B. An outer edge 110 defines an outer diameter $D_{OUT}$ and an inner edge 112 defines an inner diameter $D_{IN}$ as well as a cavity 114. The body 102 has a circular shape. The inner diameter $D_{IN}$ is sufficiently dimensioned to fit over a billiard ball for placement of the body 102 about the billiard ball and onto a surface of the billiard table surrounding the ball. As illustrated in FIG. 1B, a thickness $D_{TH}$ of the body 102 is defined between the upper surface 102 and the lower surface 108 and in some embodiments is substantially thin or minute so as to minimally impact the travel of pool balls over the body 102 when the device 100 is positioned on the surface of the table. Additionally, an adhesive 113 can be provided on all of or a portion of the lower surface 108.

Figure 2:
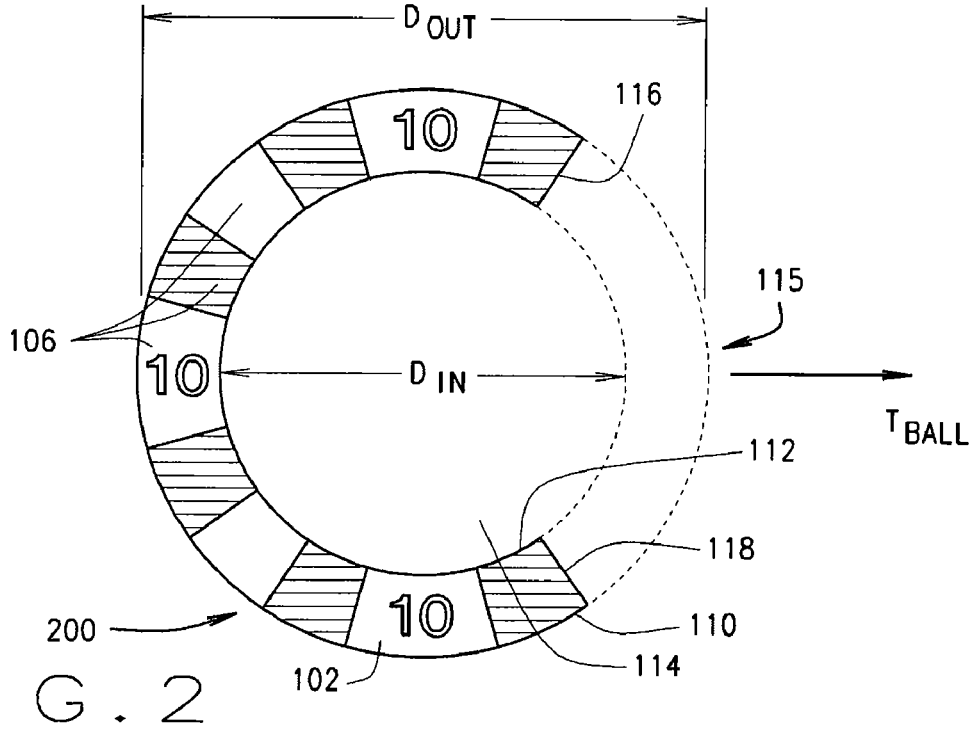
FIG. 2 is top planar view of a billiard shot practicing device having a C-shaped circular body and including unique ball indicia according to another exemplary embodiment.

In another embodiment, the billiard shot practicing device 200 of FIG. 2 has a C-shaped body 102. As shown in this exemplary embodiment, the body 102 is substantially circular with the outer edge 110 defining the outer diameter $D_{OUT}$ and the inner edge 112 defining the inner diameter $D_{IN}$ and the cavity 114. A gap 115 is formed between a first free end 116 and a second free end 118 to form the C-shaped body 102. The gap 114 can be dimensioned to permit the clear travel of a billiard ball in direction of travel of the ball $T_{BALL}$. The device 200 includes indicia 106 that in this example is the number "10," and blue colored stripes, all of which correspond to the standard indicia associated with the number 10 billiard ball.

Figure 3:
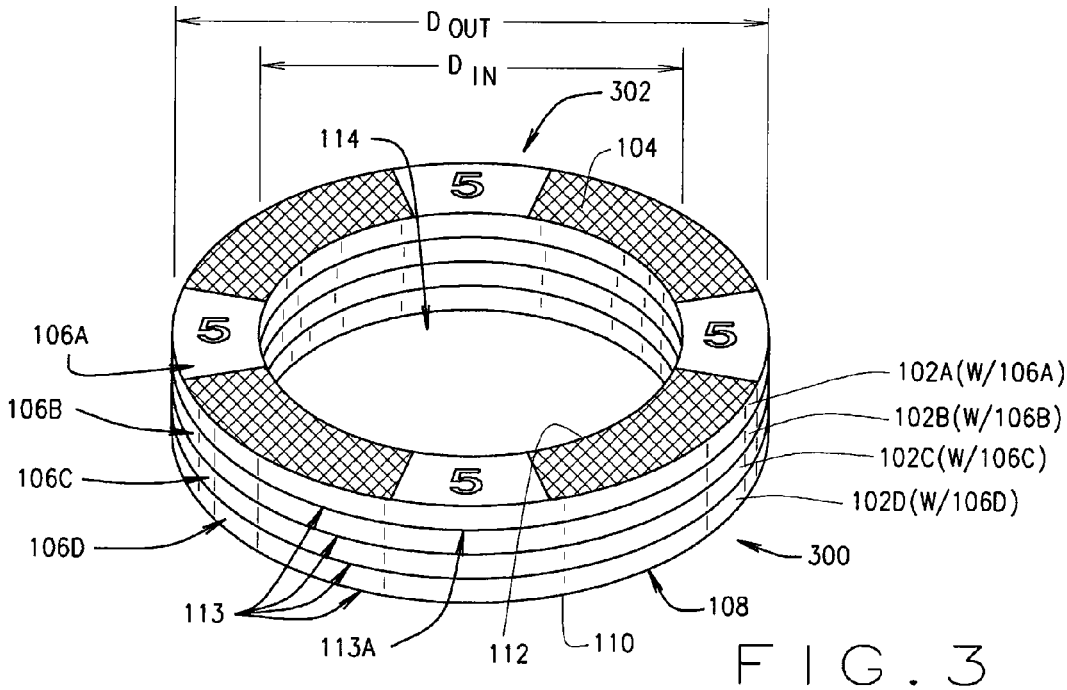
FIG. 3 is a side perspective view of a stack of billiard shot practicing devices forming a system and including positioning adhesive according to yet another exemplary embodiment.

As shown by the exemplary embodiments of devices 100 and 200, a plurality of devices can be provided each with different and unique indicia 106 corresponding to a different billiard ball within a set of billiard balls. One example of such a system 300 is illustrated in FIG. 3 where a stack 302 of four circular devices 100. On the top of the stack 302 is a first body 102A with indicia 106A associated with the number 5 billiard ball and having an adhesive 113A on its lower surface 108 (not shown). A second body 102B is directly below the first body 102A and is indicated to include indicia 106B associated with the number 6 billiard ball. A third body 102C is directly below the second body 102B and is indicated to include indicia 106C associated with the number 7 billiard ball. A fourth body 102D is directly below the third body 102C and is indicated to include indicia 106D associated with the number 8 billiard ball. Each body 102 within the stack 302 includes the outer edge defining outer diameter $D_{OUT}$ and an inner edge defining the inner diameter $D_{IN}$ and the cavity 114. Additional bodies 102 with additional separate indicia 106 can be provided in a stack 302 as the stack 302 of FIG. 3 can be a partial stack associated with only four billiard balls, wherein there are typically 16 balls in a set of billiard balls (a cue ball and 15 numbered balls). Each can be provided with a portion of adhesive 113 on a lower surface 108. Additionally, as described above a stack 302 can be formed of bodies all having the same indicia 106 wherein a different stack 302 would be provided for each ball in a set of billiard balls. Additionally, while not shown, the stack 302 of bodies can be provided without indicia 106, but include an upper surface 104 that is adapted to enable a player to mark or write his own indicia on the upper surface 104 at the time of use of the device 100.

Figure 4:
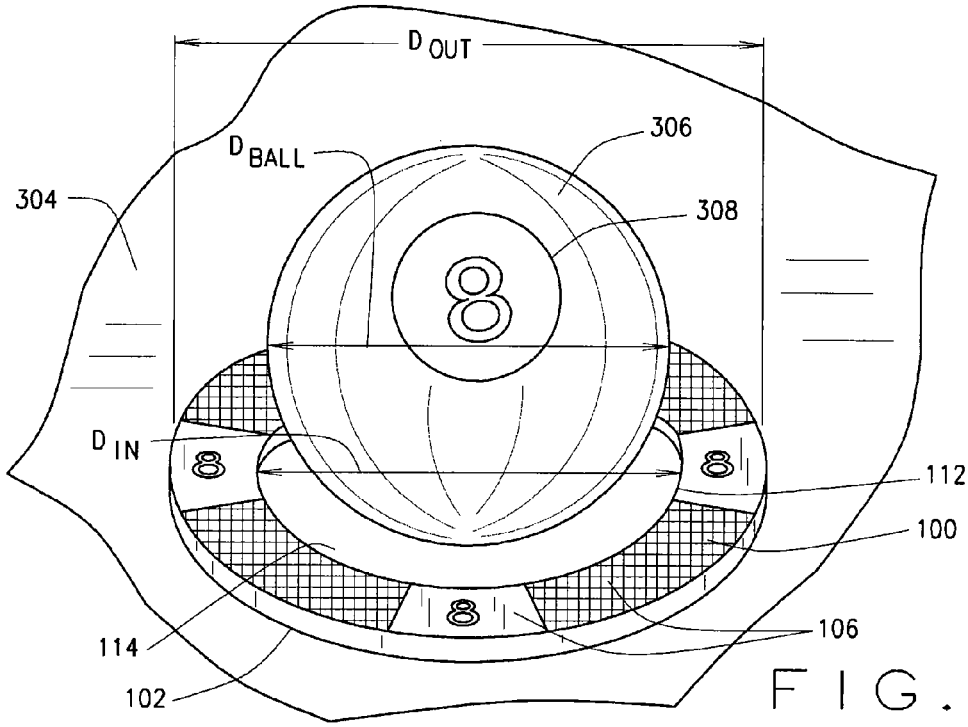
FIG. 4 is top perspective view of a felt surface of a billiard table illustrating the placement of a billiard shot practicing device body about a billiard ball and on the felt surface for marking the position of the ball for practicing the billiard shot.

FIG. 4 illustrates the placement of the device 100 on a surface 304 of a pool table and about a ball 306. As shown, the ball 306 includes ball indicia 308 that is indicated as the 8-ball. The indicia 106 on the body 102 of the device 100 includes the number 8 and can also include a solid black colorization that is associated with the 8-ball. The inner edge 112 defines the cavity 114 and the inner diameter $D_{IN}$ that is at least greater than a diameter of the ball $D_{BALL}$. As illustrated, the body 100 is positioned on the table surface 304 and about the ball 306 and is configured to be placed over the ball 306 without disturbing the position of the ball 306 on the table surface 304. Once placed as shown in FIG. 4, the player can take a first shot that can result in the movement of the ball 306 from within the cavity 114 of the body 100. After the first shot is taken, the player can replace the ball 306 back to within the cavity 114 of the body 100 for providing the placement of the ball 306 on the table surface 304 in substantially the same position. This is made possible since the body is configured to not move or change position on the surface 304 during the taking of the first shot. This process can be repeated multiple times with multiple balls 306 and multiple bodies 100 on the surface 304 in repetitively practicing a billiard shot.

Based on the above description of the device and system, it can be apparent to those skilled in the art that various methods can utilize such devices and systems for practicing a billiard shot. For example, in one embodiment a method of practicing a billiard shot includes placing a different body about each of two or more billiard balls wherein the bodies are placed on a surface of a billiard table. Each of the two or more billiard balls has a predefined position on the surface of the billiard table that is therein marked by the placement of the bodies about the balls. After having placed the bodies about the balls, the user then takes a first billiard shot including the two or more billiard balls.

After taking a first shot on the two or more balls, the user replaces each of the two or more billiard balls within a cavity of the body defined by each body that was previously placed about each ball. The bodies are in substantially the same position as previously placed before taking the first shot. Having replaced the balls to within the cavity of the bodies each ball is placed in substantially the same position as before taking the first billiard shot. The user then takes a second billiard shot including the same two or more billiard balls from substantially the same predefined position. The replacement of the balls to within the cavity of the bodies and the taking of the second billiard shot are thereafter repeated to enable the user to practice the same billiard shot over and over as many times as desired. Additionally, the user can move one of the placed bodies between shots to vary position of the balls for variations on the practiced shot.

Figure 5:
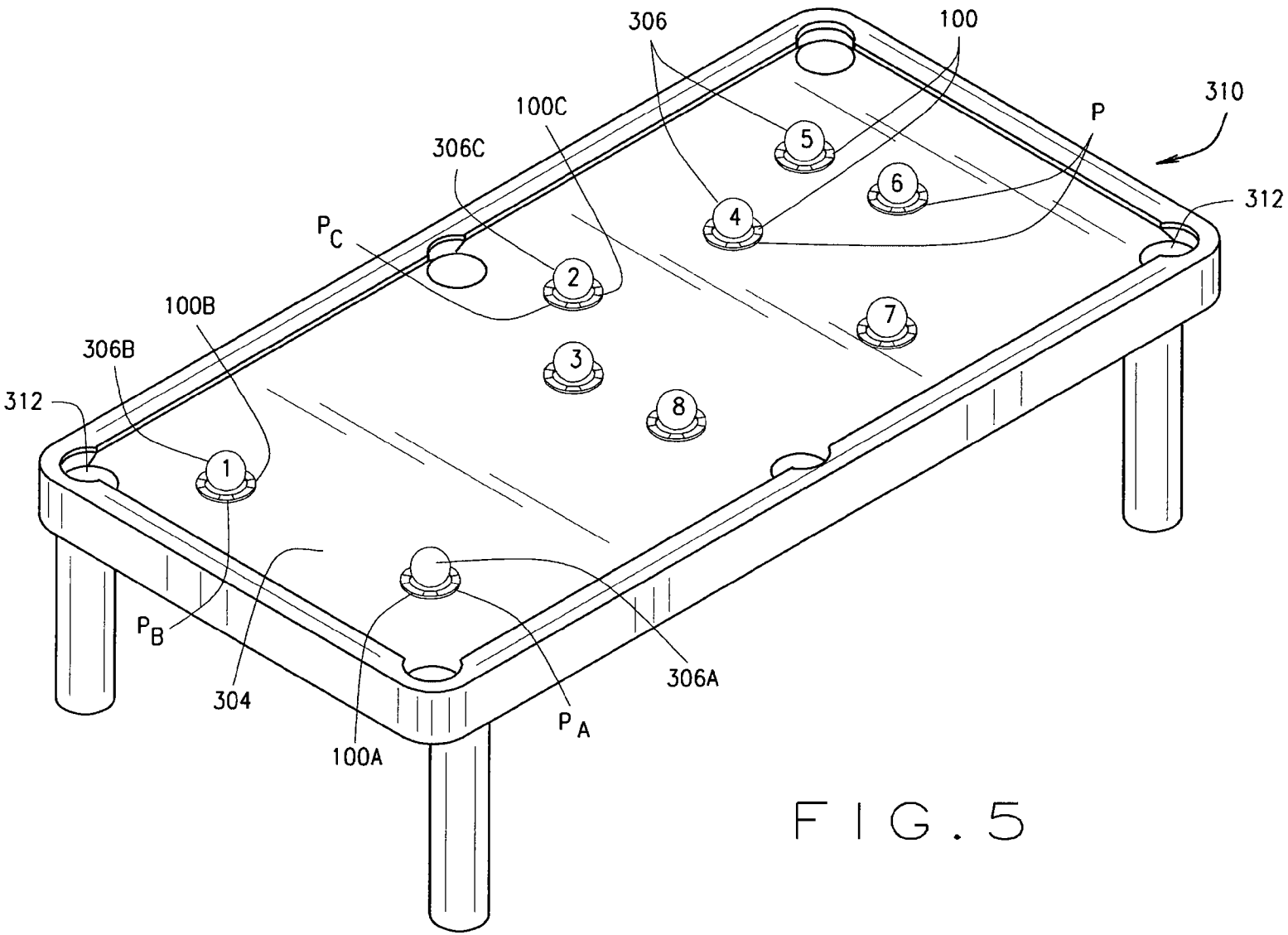
FIG. 5 is a top perspective view of a billiard table having a plurality of billiard balls in predefined positions on the surface with each being marked by a billiard shot practicing device according to one embodiment of the billiard shot practicing system and method.

FIG. 5 illustrates one example of such a billiard shot practicing method. A billiard table 310 includes the table surface 304 (such as a felt surface) and pockets 310. Two or more balls 306 are positioned on the surface 304. The position P of each ball 306 on the surface 304 is marked by at least one device 100 by placement of the device about each ball 306. The details of three specific balls 306, devices 100 and positions P will now be addressed by way of example.

The cue ball 306A is marked at position $P_A$ by placement of device 100A about the ball 306A on the surface 304 at position $P_A$. The 1-ball 306B is marked at position $P_B$ by placement of device 100B about the ball 306B on the surface 304 at position $P_B$. The 8-ball 306C is marked at position $P_C$ by placement of device 100C about the ball 306C on the surface 304 at position $P_C$. The other balls 306 are similarly marked on the surface 304 at their respective position P with similar devices 100. In operation, the player positions each of the devices 100 about the balls 306 to mark their positions P. In the alternative, the player places the devices 100 on the surface 304 at the desired positions P and then places the balls 304 within the cavities 114 of each body 102 of the devices 100.

In either case, once the balls 304 are placed within the cavities 114 of the devices 100, the player takes a first shot by striking the cue ball 306A which then travels to strike one or more of the other balls 306. Each of the other balls 306 can then also strike one or more other balls 306. Once all of the balls 306 come to rest after the first shot, some or all of the balls 306 will have moved from their prior pre-shot position P on the surface 304 and some may have entered one of the pockets 310. At this time, the player can analyze the resulting position of each ball 306 as well as their paths of travel and interactions. The player can then replace each of the balls 306 to the cavity 114 of each respective device 100 for practicing the same shot again with each of the balls 306 being in substantially the same position as with the first shot. As noted above, each of the bodies 100 can includes indicia 106 corresponding to each billiard ball 306 to aid in the placement of each ball 306 to the same position P for each practiced shot. Such indicia 106 can include corresponding color, number and pattern of the balls and can aid in replacement of each ball 306 to the same position P as before the prior practice shot.

In some cases, the player can also move one or two of the bodies 100 and therefore their associated balls 306 to practice a variation of the shot. Once the player has completed his practicing of shots, the devices 100 can easily be removed from the surface 304 and stored for the next shot practice session or thrown away.

Also as noted above but not shown in the exemplary embodiment of FIG. 5, the bodies 100 can include the gap 115 in the body 102 so that placement of the body 102 about a ball 306 can include aligning the gap 115 with the planned direction of movement $T_{BALL}$ of one or more balls 306. The body 102 with a gap 115 also provides for the movement of the ball 306 directly on the surface 304 of the 310 table without having to roll or travel on the upper surface 104 of the body 102 that is place about the ball 306 and on the table surface 304.

The placement of the device 100 on the surface 304 of the table 310 can also include selectively and temporarily affixing each device 100 to the surface 304 when placing the body 102 about the ball 306 and on the surface 304. Such affixing can include affixing a temporary adhesive 113 associated with all or a portion of the lower surface 108 of the body 102. In some embodiments, such temporary adhesive is a slight adhesive compound or material that can provide for at least slightly affixing the body 102 to the surface 304 to minimize any movement of the device 100 on the surface 304, but also not affixing to the extent that removal is difficult or damaging to the surface 304 and that no residue is transferred to the surface 304.

Those skilled in the art of billiards will understand that disclosed billiard shot practicing device, system and methods are a significant improvement in aiding the effective and accurate practicing of a shot.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A method of using a plurality of devices for repetitively practicing a billiard shot with a set of a plurality of billiard balls on a surface of a billiard table, the method comprising:

defining a position for each particular one billiard ball within the plurality of billiard balls on the surface of the billiard table, each of the billiard balls in the set of billiard balls having a predefined first position on the surface of the billiard table, the defining including positioning a plurality of devices about each billiard ball on the surface of the billiard table, each device having an upper planar surface, a lower planar surface for flat placement on the surface of the billiard table with the lower planar surface being substantially parallel to the upper surface, an outer edge defining an outer diameter and a cavity defining an inner edge having an inner diameter, wherein the inner diameter is slightly greater than an outer diameter of a standard billiard ball and wherein the lower and upper planar surfaces are defined between the inner and outer diameters and wherein positioning each device about each billiard ball on the surface of the billiard table includes positioning each ball within the cavity of a corresponding one of the devices, each device having a thickness between the upper planar surface and the lower planar surface that is substantially minute wherein each device has a substantially planar profile defined between the upper planar surface and the lower planar surface and the thickness of the device provides no more than a minimal impact to a travel of the billiard ball over the upper planar surface of the device and across the surface of the billiard table after the device is positioned about the billiard ball and flat on the billiard table surface;

selectively securing each device to the surface of the billiard table with each ball within the cavity of the corresponding device in its first position by attaching an adhesive material from the entire lower planar surface of the device to the surface of the billiard table;

taking a first billiard shot including the two or more of the billiard balls while each billiard ball is within the cavity of each corresponding device in their first position, the taking including a first movement for each of two or more of the billiard balls about the surface of the billiard table from their first position and to a second position for each of the two or more billiard ball with the second position being outside of the cavity of the corresponding device;

replacing each of the two or more billiard balls to their first position on the surface of the billiard table and within the cavity of each corresponding device; and taking a second billiard shot including the replaced two or more billiard balls, the taking of the second billiard shot including a second movement for each of the two or more billiard balls about the surface of the billiard table from their first position and to a third position outside of the device cavity, wherein the third position of each of the two or more billiard balls is different than the second position thereof.

2. The method of claim 1 wherein defining a position for each particular one billiard ball includes positioning a first device about a first billiard ball having a first assigned number indicator and a first color, wherein the first device includes first printed indicia on its upper planar surface including the first assigned number indicator and first color, and positioning a second device about a second billiard ball having a second assigned number indicator and a second color, wherein the second device includes second printed indicia on its upper planar surface including the second assigned number indicator and second color, wherein the second assigned number is different than the first assigned number and the second color is different than the first color.

3. The method of claim 1 wherein each device includes a gap between the outer edge and the inner edge providing an opening to the cavity and wherein positioning a plurality of devices about each billiard ball includes aligning the gap in the device with an expected direction of movement of the billiard ball.

4. The method of claim 1, further comprising removing each of the different bodies from a stack of devices prior to the positioning on the surface of the billiard table for defining the position.

5. The method of claim 1, further comprising removing each of the different devices from a stack of devices prior to the positioning on the surface for defining the position.

6. The method of claim 1, further comprising removing one or more of the plurality of devices that are selectively secured to the surface of the billiard table in a first position and selectively securing each removed device on the surface of the billiard table in a second position on the surface of the billiard table.

* * * * *